United States Patent [19]

Beckman et al.

[11] 4,356,672

[45] Nov. 2, 1982

[54] PARTITIONING SYSTEM

[75] Inventors: Ronald H. Beckman, Providence; Howard K. Yarme, Foster, both of R.I.

[73] Assignee: Vaughan Walls, Inc., Zeeland, Mich.

[21] Appl. No.: 119,667

[22] Filed: Feb. 8, 1980

[51] Int. Cl.[3] ..... A47B 5/00

[52] U.S. Cl. ..... 52/36; 52/281; 52/238.1

[58] Field of Search ..... 52/281, 282, 241, 239, 52/36, 238

[56] References Cited

U.S. PATENT DOCUMENTS

| | | | |
|---|---|---|---|
| 3,193,061 | 7/1965 | Downes | 52/281 |
| 3,736,706 | 6/1973 | Stephenson | 52/484 |
| 3,768,222 | 10/1973 | Biram | 52/282 |
| 3,875,721 | 4/1975 | Mengeringhausen | 52/282 |
| 4,019,291 | 4/1977 | Ernst | 52/36 |
| 4,021,973 | 5/1977 | Hegg | 52/36 |
| 4,067,161 | 1/1978 | Rensch | 52/281 |
| 4,101,231 | 7/1978 | Streib | 52/282 |
| 4,231,197 | 11/1980 | Caplan | 52/282 |

FOREIGN PATENT DOCUMENTS

| | | | |
|---|---|---|---|
| 2103502 | 12/1972 | Fed. Rep. of Germany | 52/282 |
| 2314866 | 2/1974 | Fed. Rep. of Germany | 52/281 |
| 2258006 | 5/1974 | Fed. Rep. of Germany | 52/281 |
| 2747637 | 5/1978 | Fed. Rep. of Germany | 52/281 |
| 2845017 | 4/1980 | Fed. Rep. of Germany | 52/282 |

*Primary Examiner*—John E. Murtagh
*Assistant Examiner*—Henry E. Raduazo
*Attorney, Agent, or Firm*—Varnum, Riddering, Wierengo & Christenson

[57] ABSTRACT

A partitioning system for segmenting an open area into smaller compartment-like regions includes a grouping of multifunction, interchangeable standardized component parts which are selectively utilized according to the partitioning panel designs to be assembled and the particular configuration desired. The partitioning system includes structural wall panels of a unitized, laminated gypsum sheet construction, window panels, acoustical screens, and door members. Angled joints between adjacent panels include a corner spacer which has a series of radially spaced slots for receipt of face plate members with resultant included angles of either 90°, 135° or 180° and the face plate members are configured for snap-fit with variously styled partitioning panel connectors. The partitioning system is configured for easy and quick assembly and disassembly as well as revisions of the particular layout by merely unsnapping certain partitioning panels and reattaching different panels or the same panel in a different orientation. Each panel-to-panel joint may be configured with slotted standards for support of hang-on furniture thereby incorporating a further desirable feature.

16 Claims, 21 Drawing Figures

PARTITIONING SYSTEM

BACKGROUND OF THE INVENTION

This invention relates in general to movable partitioning systems and in particular to such systems which are relocatable and interchangeably configured for wall panels, acoustical screens, glass panels, doors and suspended ceilings.

The concept of partitioning systems whereby an open area is segmented into individual compartment-like regions has been utilized for several years in large office complexes as well as in factories, stores and related businesses. Structurally, the concept entails the use of wall panels which are securely joined together and anchored in place between the floor and ceiling. Although a floor track or bracket is commonly employed regardless of the height of the wall panels, a ceiling runner is frequently found when the wall panels are full height.

The choice of wall panel material, while important from a structural aspect to those required to fabricate and install the panels, is equally important to the office personnel who are affected daily by such factors as durability, acoustical and fire-retardant properties and the aesthetics of color and texture. Partitions come in a variety of common materials such as wood, aluminum, steel and plastic laminants. While these materials have strength and durability advantages, they are quite inflexible dimensionally, once fabricated and delivered to the installation site. Minor variations in floor-to-ceiling dimensions or length dimensions to enclose a space result in a less-than-perfect fit or mismatch. If this mismatch is severe enough, a new panel must be ordered or the existing panel reworked. Although field rework is more desirable from a cost and time standpoint than factory rework or redo, and the ability to rework a panel eliminates waste of ordered panels which do not fit. However, field rework of aluminum and steel is difficult, at best, because of the machine tool requirements.

One material which is believed to be optimal for partitioning systems is gypsum and by laminating two face boards together spaced apart by core boards, a durable, rigid panel is created. Gypsum is excellent in its sound control and fire-retardant properties and when vinyl covered, results in a most pleasing interior design medium. One of the most beneficial factors to the installers is the extreme ease that gypsum panels can be dimensionally altered. If a little needs to be taken off of an edge, on-site rework is extremely easy using only conventional hand tools. The primary concern with the use of gypsum wall panels is the inability of the walls to support heavy surface-applied loads which create pull-out forces on the vertical surface. The properties of the material must also be considered when joining techniques are involved. Consequently, the joining technique between panels, whether straight runs (180°) or angled joints (less than 180° included angle), must be configured to compensate for lesser strength of the gypsum material in order to provide the requisite strength and rigidity of a suitable partitioning system.

Partitioning systems generally provide a quick and economical means to convert an open space into a particular office and officette configuration which can be uniquely designed with almost limitless variety. Recently, two concepts somewhat new to the technology of partitioning systems have come into being. The first concept involves the use of "hang-on" furniture components, such as desks, tables, bookcases, etc. As the name implies, these furniture items are literally hung onto the wall by means of slotted vertical standards and a supporting bracket arrangement often supplied as part of the furniture items or added to the furniture items. This type of furniture does not have legs or similar members in order to enable the furniture to rest on the floor surface and thus, the floor (often carpet) is free and unencumbered for easy vacuuming, shampooing, or waxing without the necessity to move the furniture. Currently, aluminum and steel partitioning systems which incorporate the slotted standards concept do so as part of the panel-to-panel joint and the formed joint which normally includes a locking post which is preslotted for this purpose. If hang-ons are not used, a cover piece snaps into and over the not-used standards for a more pleasing appearance. The preslotting of every locking post entails a greater per-piece cost due to the additional machining work needed to incorporate slots and the need for separate cover pieces to cover the unused standards. The inefficiency of this method is heightened by a realization that quite often only a few of the panel-to-panel joints will be utilized for hang-on applications and thus, a majority of these preslotted locking posts are not utilized for their intended function.

Laminated gypsum panels of the type discussed above do not use a locking post and thus a requirement for such gypsum panels and desirable for other panels is to provide a specially configured slotted standard which is suitable for selective utilization only when hang-on furniture is involved and only at those locations where the furniture will be positioned. This selective utilization provides an efficiency over present aluminum and steel partitioning systems and is particularly adaptable to laminated gypsum panels, as will be apparent from the descriptions which follow. The limited load-supporting strength of gypsum panels, as previously mentioned, necessitates that the joint between panels be utilized for support of the slotted standards which in turn support the hang-on furniture. The present invention discloses such a slotted standard concept which is suitable for the above objective and comprises one unique feature of a larger partitioning system disclosed herein.

The second recent concept involves the marrying of a full-height wall panel partition system with acoustical screen panels. Acoustical screens are often employed in crowded work areas to visually and acoustically shield one work area from adjacent areas. Very often the acoustical screens do not extend from floor to ceiling but are only about half height. This concept provides additional privacy, but more importantly reduces the transmission of noises between various work stations. When a large area is being designed into smaller areas incorporating wall panel partitions and acoustical screens, an inefficiency presently results. Those contractors which offer installation of a wall panel partitioning system do not provide compatible hardware for combination with acoustical screens because such hardware does not exist. Similarly, those subcontractors involved in the arrangement and mounting of acoustical screens do not offer designs which are compatible with wall panel partitioning systems. This inefficiency is the result of design and dimensional incompatibilities between the two systems and the lack of interchangeable, multifunction components adaptable to both types of panels. At the present time, the prior art technology does not reveal any wall panel partitioning systems which can be mutually assembled with acoustical screens in a virtually unlimited number of configurations. Further, the dimensional characteristics of wall panels are not presently compatible with acoustical screens and vice versa. Clearly, if a composite system assembly could be devised in order to enable a virtually unlimited variety of wall panel and acoustical screen configurations using select component parts from a basic set of standardized parts, not only would dimensional compatibility exist, but one contractor could be responsible for the entire job. Although this is definitely cost effective, it also results in an overall system which appears uniform and consistent rather than a hodge podge of miscellaneous parts that are not compatible.

The present invention discloses such a partitioning system involving structural wall panels, glass panels, acoustical screens, doors and ceilings; all of which are easily assembled using selected multifunction components. The number of possibilities is virtually endless and the speed of system assembly results in extremely rapid office and officette construction. The disclosed system provides the various advantages previewed above and is believed to be novel and not anticipated nor rendered obvious by any prior art concepts.

SUMMARY OF THE INVENTION

A partition assembly for segmenting an open area into smaller compartment-like regions according to one embodiment of the present invention comprises a plurality of panel members joined together at panel joint locations, a plurality of panel connectors designed and arranged for joining with the panel members, there being one panel connector corresponding to each panel member joined at each panel joint location, a plurality of face plate members cooperatively arranged with the panel connectors for snap-fit receipt of the panel connectors and a corner spacer cooperatively arranged with the face plate members for simultaneous attachment with a plurality of the face plate members.

One object of the present invention is to provide an improved partitioning system wherein structural wall panels, glass panels, acoustical screens, and doors may be selectively combined in a variety of configurations.

Related objects and advantages of the present invention will be apparent from the following description.

DESCRIPTION OF THE PREFERRED EMBODIMENT

Figure 1:
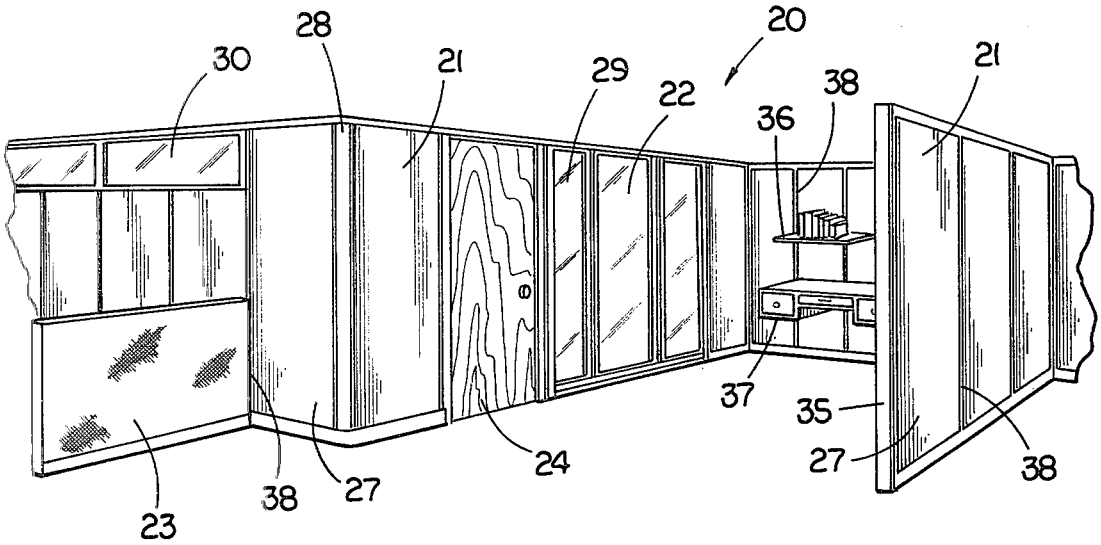
FIG. 1 is a partial perspective view of a partitioning system according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a partitioning system 20 including at least one structural wall panel 21, glass panel 22, acoustical screen 23, and door member 24. The arrangement of various panels, screens and door members is an attempt to provide some indication of the variety of structural configurations possible and although a majority of panel, screen and door member interface joints have been configured, there are additional configurations possible within the teachings of this invention as will be apparent once the interchangeable, standardized component parts are described.

As is illustrated in FIG. 1, the structural wall panels may be full height as 21 or of a shorter height as illustrated by panels 27 and panel-to-panel joints such as 28 are finished with an exterior strip of vinyl for a more pleasing appearance. The glass panels 22 may also be similarly configured into a variety of differently dimensioned shapes such as glass panels 29 and 30. The top and bottom edges of system 20 are configured with a ceiling runner and a floor track, both of which will be described in greater detail hereinafter. These members are arranged so as to enclose the ceiling to panel joint and the floor to panel joint. Edge trim pieces 35 (end caps) are also included to enclose the terminating edge of an outwardly projected panel which is not otherwise enclosed or joined to additional panel members or screens.

Two concepts new to partitioning systems generally are illustrated by FIG. 1; namely, the incorporation of acoustical screens 23 and hang-on furniture items such as book shelf 36 and desk 37. The acoustical screens are arranged in such a manner so as to adapt to standardized hardware components which are cooperatively arranged to assemble to any panel joint location 38. These various joint locations incorporate a somewhat standardized construction which is selectively variable, depending upon the panels to be joined at that point and the desired angular relationship of such panels. The acoustical screens are compatibly configured so that they may be interchangeably used with structural wall panels or glass panels or door members in a virtually unlimited variety of configurations. The hang-on concept for furniture such as book shelves, desks, tables, file cabinets, etc., relies on the use of slotted standards which may be attached in a vertical orientation at any panel joint location 38. By standardizing the width of each structural wall panel and the joint construction, the slotted standards are located on fixed centerline distances and the hang-on furniture has a compatible bracket spacing for attachment to these spaced standards. This hang-on feature allows modularized furniture to be used while keeping the floor area therebeneath free of legs and other structural encumberances. A further feature is the ease that such furniture may be moved and relocated and the interior design of offices infinitely changed simply by moving the furniture from attachment to one set of standards to another set of standards.

Figure 2:
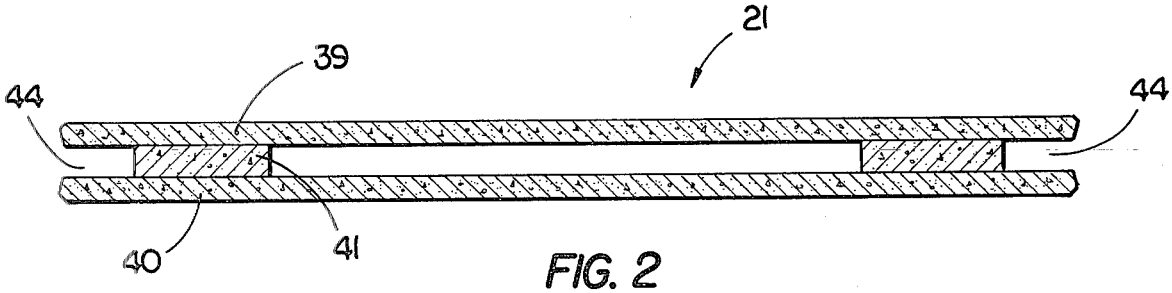
FIG. 2 is a reduced-size top plan section view of a laminated wall panel comprising a portion of the FIG. 1 system.

Referring to FIG. 2, the construction of a structural wall panel 21 is illustrated. Wal panel 21 is constructed gypsum and includes two face boards 39 and 40 equally spaced apart in a laminated type of construction by a plurality of coreboards 41. Each wall panel 21 is nominally 30 inches in overall width and approximately 2¼ inches in thickness. The use of gypsum material provides a number of advantages over wood, aluminum alloys or steel alloys. Gypsum is extremely fire-retardant and has excellent sound-controlling properties. The material is easily altered at the installation site by conventional hand tools such as a dry wall cutting knife. Thus, the need for expensive dimensional modifications is eliminated. Panel 21 is covered with a vinyl wall covering which in the exemplary embodiment is applied at the time of fabrication and is shipped to the installation site ready for installation. Other wall coverings may equally well be applied including paneling, wallpaper, painting and related materials. These finishes may be factory applied or applied at the installation site. The laminated construction not only improves the strength and durability of single-panel designs, but provides a more pleasing appearance due to the increased thickness which conforms more closely to conventional wall construction. The coreboards are set in from the edge approximately 2¼ inches in depth and thus, a complete peripheral edge groove 44 is created between the two face boards. This groove is utilized for all panel-joining techniques, regardless of the type of joint or connection employed. Thus, the spacing between boards and the depth of groove 44 are design considerations.

Figure 3:
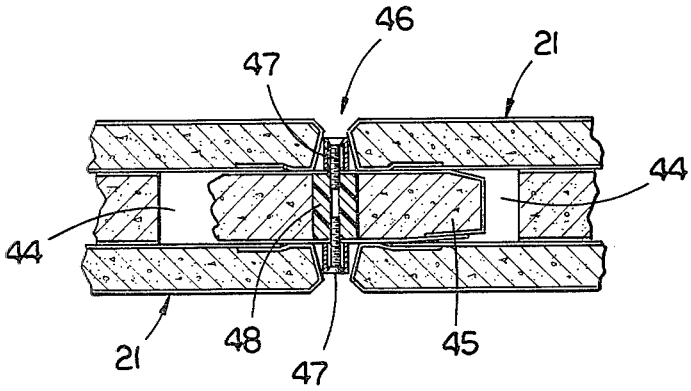
FIG. 3 is a partial top plan section view of a panel-to-panel straight joint comprising a portion of the FIG. 1 system.
Figure 4:
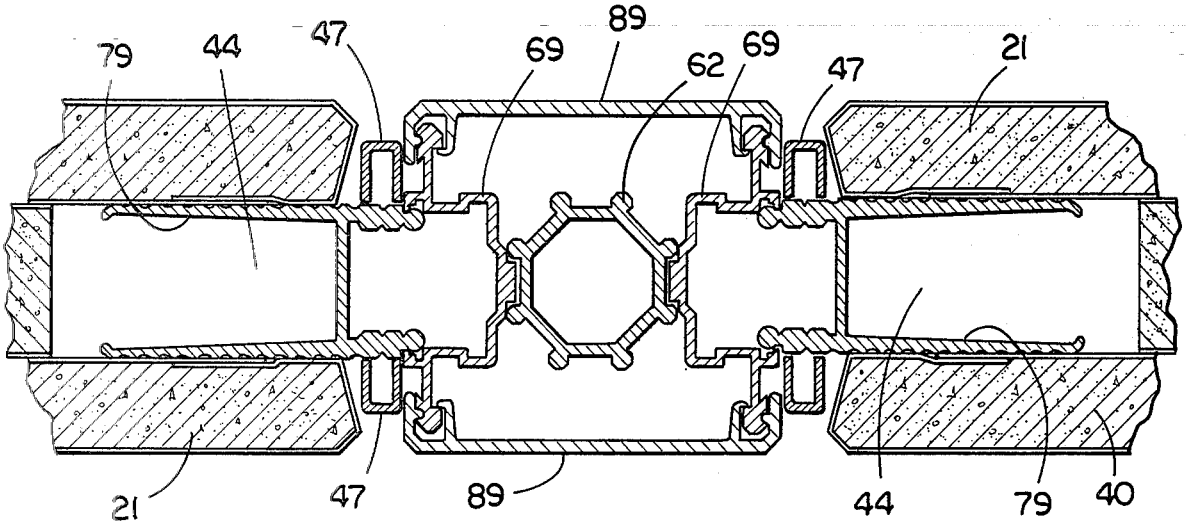
FIG. 4 is a partial top plan section view of an alternative panel-to-panel straight joint comprising a portion of the FIG. 1 system.

Referring to FIGS. 3 and 4, two concepts for a panel-to-panel straight (180° ) joint are illustrated. In FIG. 3, a 4-inch coreboard spline 45 is inserted into grooves 44 of two ajacent panels 21. The depth of insertion of coreboard spline 45 is approximately 1.84 inches leaving a panel-end-to-panel-end space 46 of approximately 5/16 of an inch. Space 46 is utilized for the positioning of slotted standards 47 which are utilized with the hang-on furniture, previously discussed as part of FIG. 1. Coreboard spline 45 includes a nylon insert 48 and the slotted standards 47 are attached to the spline by means of steel metal screws which extend into the nylon insert. With appropriate centering of the coreboard spline between the two adjacent wall panels and proper locating of the slotted standard, the centerline-to-centerline spacing between adjacent standards is approximately 30-5/16 inches. In order to assure accurate spacing between adjacent joint centerlines and between facing edges of adjacent panels, spacer clips are employed at either the top, the bottom, or at both locations of each joint. The FIG. 4 illustration involves a unique concept of standardized joint components and although mention of these components is made only generally at this point, specific reference will be made to each and every component and their method of attachment hereinafter. Once these individual components are more fully detailed, the description of the present invention will return to FIG. 4 for a more detailed discussion.

Figure 5:
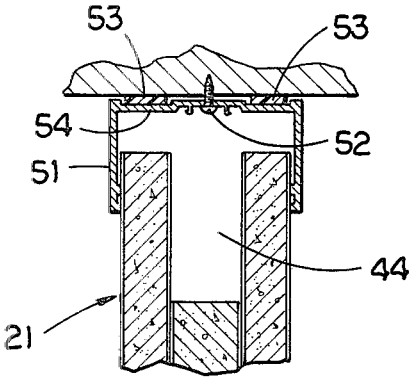
FIG. 5 is a partial side elevation section view of a wall panel and ceiling runner comprising a portion of the FIG. 1 system.

When it is desired to secure the various structural wall panels and other components of partitioning system 20 to the ceiling or an overhead supporting structure, a ceiling runner 51 is attached to the ceiling at a plurality of points along its length by threaded fasteners 52 (see FIG. 5). It is to be understood that ceiling runner 51 is an aluminum extrusion and thus its length may be selectively established at the time of installation. Two compressed polyurethane seals 53 are positioned on opposite sides of the threaded fasteners between the top surface of the ceiling runner and the inside surface of the ceiling. These seals provide light and sound sealing characteristics to the ceiling runner. The lower portion of ceiling runner 51 is configured in an open U-shape so as to receive structural wall panel 21. Additional clearance must be left between the top edge of the wall panel and inside surface 54. This additional clearance space is utilized for the elevation of panel 21 at the time it is installed into a floor track. By raising panel 21 upwardly, the lower edge of the panel is raised to a point of elevation above the uppermost surface of the floor track. This enables the floor track to be secured in position before the panel is mounted in place. Once panel 21 is lowered onto the floor track, the panel assumes its positional relationship with respect to the ceiling runner 51 that is illustrated in FIG. 5.

Figure 6:
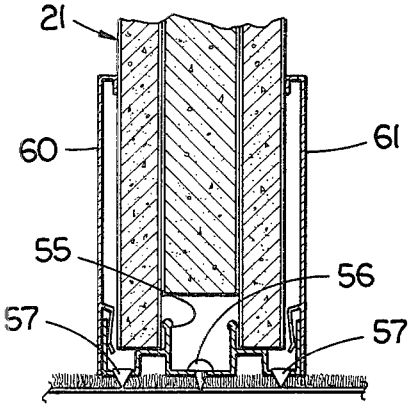
FIG. 6 is a partial side elevation section view of a wall panel and floor track comprising a portion of the FIG. 1 system.

Referring to FIG. 6, the floor track 55 is illustrated as attached to a floor surface by means of mechanical fasteners 56 and carpet-penetrating teeth 57. Floor track 55 is an aluminum extrusion comprising three generally U-shaped portions. The center portion provides clearance access to threaded fastener 56 and although fasteners 56 are optional, depending upon the floor surface, the design of track 55 is standardized so that fasteners can be utilized if necessary. The other two U-shaped portions receive the face boards of wall panel 21. Once floor track 55 is moved into position and secured in place, the wall panel is moved into alignment and lowered onto the supporting surfaces of track 55. Thereafter, extruded vinyl covers 60 and 61 are snapped into position on the floor track and orient themselves into abutting engagement with the exterior surfaces of the two face boards. This construction gives a finished appearance to the baseboard area of the walls and enables a very easy assembly procedure.

Figure 7:
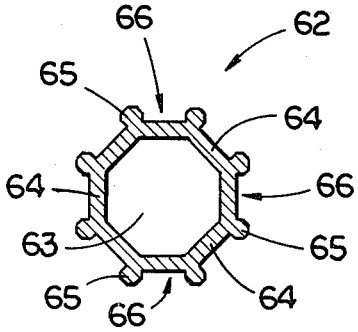
FIG. 7 is a top plan section view of a corner spacer comprising a portion of the FIG. 1 system.

Although straight runs of panels do not normally present any unique problem to the installers nor to the fabricators of partitioning systems, the construction and design become somewhat more complicated when corner joints and related panel interfaces must be provided. As was illustrated in FIG. 3, a 180° relationship between adjacent panels can be easily achieved by means of a coreboard spline inserted into the corresponding grooves of adjacent panels. However, suppose that a T-intersection was needed between three panels. Clearly, the joint concept of FIG. 3 would not be suitable for this function. In accordance with the teachings of the present invention, a series of standardized, interchangeable, multifunction component parts are disclosed hereinafter which enable a virtually unlimited combination of structural wall panels, glass panels, acoustical screens, doors, suspensed ceilings and the incorporation of hang-on furniture items. One component part, a corner spacer 62, is illustrated in FIG. 7. Corner spacer 62 is an aluminum extrusion and its lateral cross section, as illustrated, has a generally octagonal appearance. Center region 63 is surrounded by eight uniformly dimensioned and shaped contiguous wall portions 64. Outwardly extending at the interface between adjacent wall portions are polygon-shaped protuberances 65 which are arranged such that facing surfaces are parallel to each other and perpendicular to the surface of the wall portion therebetween. This particular geometry and positional relationship defines a generally rectangular slot 66 extending the full length of the extrusion. Equally spaced along each wall portion at its approximate centerline location are pilot holes for receipt of sheet metal screws, as will be described hereinafter.

Figure 8:
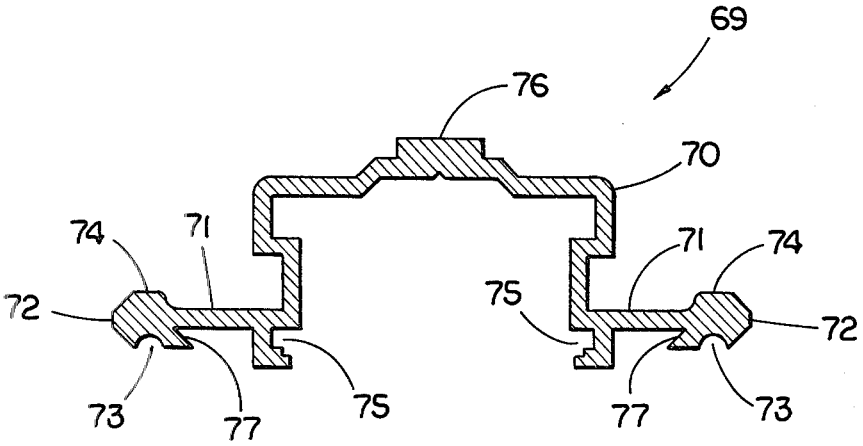
FIG. 8 is a top plan section view of a face plate member comprising a portion of the FIG. 1 system.

Referring to FIG. 8, another multifunction component part of partitioning system 20 is illustrated. Face plate member 69 includes a generally U-shaped body portion 70 and outwardly extending from the free end, on opposite sides, are two trim support arms 71. Each trim support arm has a head portion 72 specifically configured with a snap-in indentation 73, a raised portion 74 and a triangular groove 77. Each side of the U-shaped body portion includes a generally rectangular groove 75 and the two grooves are aligned with each other and inwardly facing. At the opposite end of the body portion is a generally rectangular tab 76 and uniformly spaced along the extruded length of tab 76 is a series of clearance holes.

Figure 9:
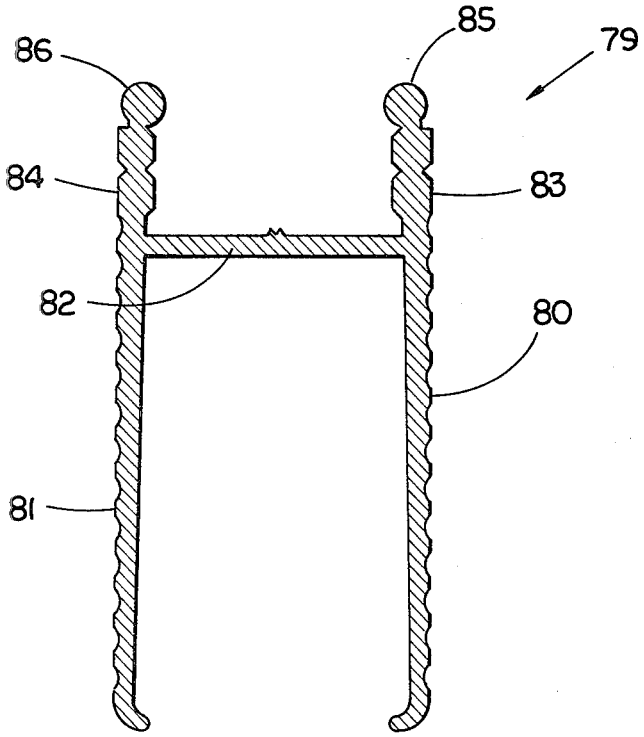
FIG. 9 is a top plan section view of a panel connector comprising a portion of the FIG. 1 system.

Referring to FIG. 9, the third primary joint component part, panel connector 79, is illustrated. Panel connector 79 like the other two primary component parts of each panel joint is an aluminum extrusion and includes two slightly tapering side walls 80 and 81 with a joining and strengthening cross member 82. The slight outward taper placed in side walls 80 and 81 enables a force fit (spring-biased) of these side walls into groove 44 of structural wall panel 21. The insertion of these side walls into groove 44 only extends to the approximate location of cross member 82 such that portions 83 and 84 remain outwardly extending from the end of the wall panel. The outermost ends of portions 83 and 84 are each configured with a generally cylindrical rib 85 and 86, respectively, which are turned slightly inwardly toward the centerline of panel connector 79.

Returning now to FIG. 4, the relationship between these primary multifunction component parts is illustrated by means of a panel-to-panel joint involving a 180° straight run and incorporating slotted standards and vinyl trim members. The first step in the assembly of the illustrated panel joint is to insert side walls 80 and 81 of panel connector 79 into groove 44 of structural wall panel 21. With the proper depth of insertion portions 83 and 84 extend outwardly from the end of these adjacent panels. The next step is to assemble the face plate members 69 to corner spacer 62. Each rectangular slot 66 of the corner spacer has a width and depth dimension suitable for receipt of rectangular tab 76 of face plate member 69. As has been previously explained, each face plate member has a series of clearance holes positioned along the length of tab 76 and the pilot holes centered within rectangular slot 66 are of similar hole-to-hole centerline spacing. Members 69 are securely and rigidly joined to spacer 62 by means of sheet metal screws passed through the clearance holes and threaded into the pilot hole. Although oppositely positioned rectangular slots are utilized for this joint, due to the fact that it is a straight run, it should be understood that by alternately positioning the face plate members in different rectangular slots, the angular relationship between adjacent panels can be varied at either 90° or 135°. Similarly, if different angular increments and spacing are desired, it is envisioned that corner spacer 62 be configured into a different number of equally spaced slots such as, for example, 6 in lieu of the 8 which are illustrated. After the various face plate members are securely fastened to the corner spacer, the panel connectors which are now anchored within the various wall panels are snapped into their corresponding face plate members. The point of snap-in attachment is by means of cylindrical ribs 85 and 86 snapping into rectangular grooves 75. The dimensional relationship between the spacing of cylindrical ribs 85 and 86 and the clearance space provided between rectangular grooves 75 requires a certain degree of force and thereby enhances the rigidity and strength of the overall assembly. However, it is still possibly to manually separate these two members when disassembly or revision of the partitioning system configuration are desired.

Figure 11:
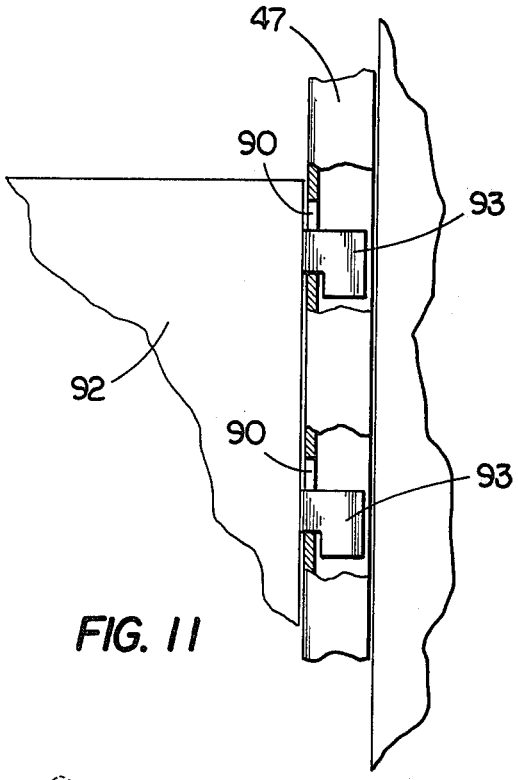
FIG. 11 is a partial fragmentary side elevation view of a bracket system incorporated with hang-on furniture and compatible with the FIG. 1 system.
Figure 11A:
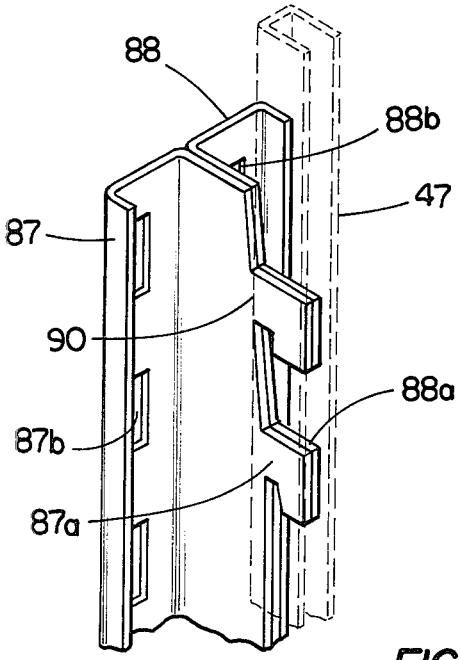
FIG. 11*a* is a partial perspective view of a dual directional bracket compatible with the FIG. 10 slotted standard.

It should be somewhat apparent that the assembly technique illustrated by FIG. 3 is simpler than that illustrated by FIG. 4 but there are those circumstances when the FIG. 4 arrangement is desirable. For example, consider a partitioning system which initially is desired to have a straight run but at some future date a Tee joint or crossing intersection will be needed. By providing the various multifunction components initially, as is illustrated in FIG. 4, the addition of other panels can be accomplished by removal of the corresponding vinyl strip 89 and attachment of another face plate member. Thus, it is possible to initially configure a straight-run joint as illustrated in FIG. 4 and thereafter with a minimum of time and expense, convert the straight run to a Tee or crossing-intersection joint. Another advantage of the FIG. 4 illustration is that two slotted standards 47 may be utilized on each side of the joint with spacing of approximately $2\frac{3}{4}$ inches. This then enables side-by-side hang-on furniture to be mounted at the same elevation, in the illustrated 180° configuration and thereafter retain this hang-on furniture capability after the joint is reconfigured into a corner, Tee or crossing intersection joint. Although dual-directional brackets 87 and 88 are part of this invention (see FIG. 11*a*), these are add-on items and not provided as part of hang-on furniture when supplied. In addition to providing side-by-side mounting capabilities, they are offset to compensate for dimensional variation between the furniture support spacing and slotted standard spacing. If a joint as illustrated in FIG. 3 was utilized instead, there would only be a single slotted standard 47 and side-by-side mounting at the same elevation is achieved by the use of adpator brackets 87 and 88 (see FIG. 11*a*), two of which fit into a single slot 90 of the standard. Brackets 87 and 88 are each arranged with anchoring clips 87*a* and 88*a*, respectively, and slots 87*b* and 88*b*.

The attachment means of vinyl strips 89 should be quite apparent from the illustration and from a review of the detail part configuration in FIG. 8. The extruded vinyl strips are configured with a hooking edge which wraps around raised portion 74 and with a protuberance which snaps into indentation 73. Again, while these extruded vinyl strips are securely retained, they are equally easily removable by manual means.

Figure 10:
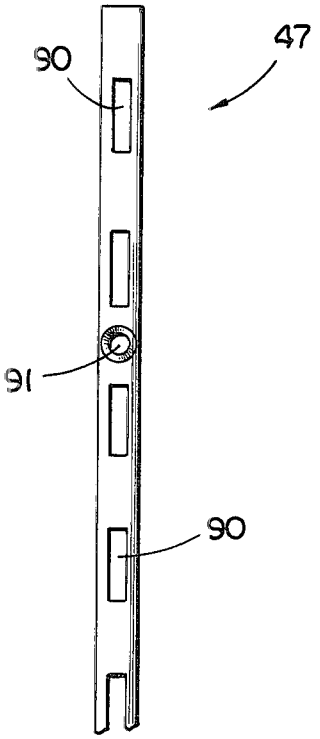
FIG. 10 is a partial front elevation view of a slotted standard comprising a portion of the FIG. 1 system.

Referring to FIG. 10, slotted standard 47 is illustrated in greater detail. Each standard is a steel roll-formed shape wherein the rectangular slots 90 are on one-inch centers and the mounting holes 91 are on eight-inch centers. Each panel connector includes a series of equally spaced pilot holes also an eight-inch centerline spacing for the receipt of sheet metal screws which extend through mounting holes 91 and engage the panel connector portions 83 and 84 (see FIG. 4). Once the slotted standards are securely anchored to these panel connectors, hang-on furniture items such as 92 (see FIG. 11) may be attached to the wall. Furniture item 92 represents a unique style of furniture and if specifically intended for hang-on applications, often comes provided with attachment brackets 93. If conventional furniture is to be modified for hang-on application or if the hang-on furniture is supplied without brackes, brackets must be added. So long as the shape and dimensions of these added brackets are consistent with the slotted standards, system compatibility is preserved. Insertion of the brackets into the slotted standards is achieved by first upward tilting of the furniture item and insertion into the rectangular slots. Thereafter, the furniture item is pivotally lowered at which time the brackets lock into the slots and are rigidly retained. The use of standards 47 for hang-on furniture enables such furniture to be attached against structural wall panels, as well as against acoustical screens and glass (window) panels.

Threaded leveling devices, similar to those found with clothes washers, are located at each and every partitioning panel joint regardless of the type of joint. This individualized leveling control accommodates floor level variations and enables the establishment of a true horizontal plane for the slotted standards which is critical for level hang-on furniture.

Figure 12:
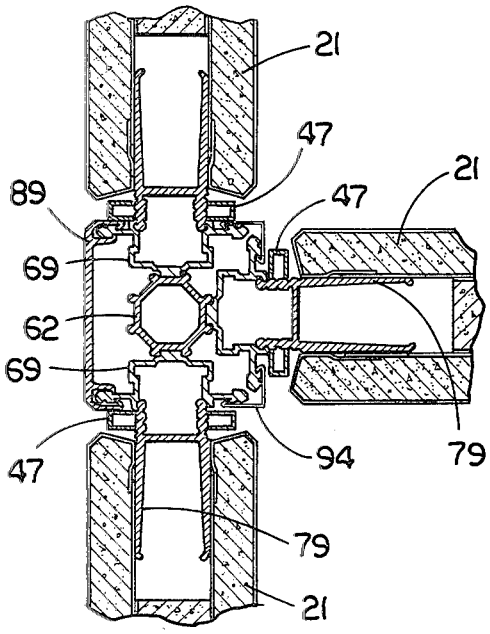
FIG. 12 is a partial top plan section view of three panels and a common joint comprising a portion of the FIG. 1 system.
Figure 12A:
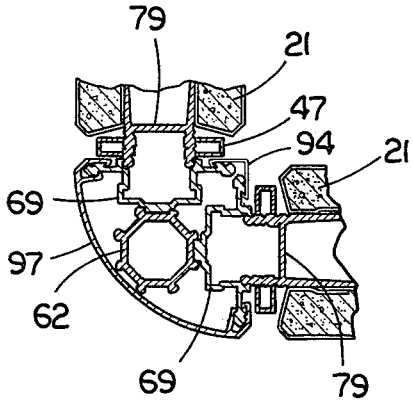
FIG. 12*a* is a partial top plan section view of the FIG. 12 three-panel joint with one panel removed.

Now that the basic understanding of the partitioning system is understood and the assembly relationship between the primary component parts has been discussed, additional features and options will now be presented in an effort to give a more complete idea of all the variations and optional features provided. Referring to FIG. 12, a three-way panel intersection joint is illustrated, and although this is virtually identical to the two-way panel joint of FIG. 4, two changes are noted. The first change which is really an addition is the inclusion of a third structural wall panel positioned perpendicular to the first two panels. Another change involves the replacement of one vinyl strip 89 with two corner vinyl strips 94 which have angled edges for engagement with triangular grooves 77. An alternative configuration to the FIG. 4 and FIG. 12 joints is illustrated in FIG. 12*a* wherein the three-way panel intersection of FIG. 12 is converted into a 90° corner intersection. Although the corner intersection may be created originally, it is also equally easy to convert the FIG. 12 configuration to the FIG. 12*a* configuration by removal of one panel. Once the panel is removed, the remaining vinyl strip 89 is replaced with a 90° curved vinyl strip 97. However, the snap-on attachment concept of vinyl strip 97 remains the same as before.

Figure 13:
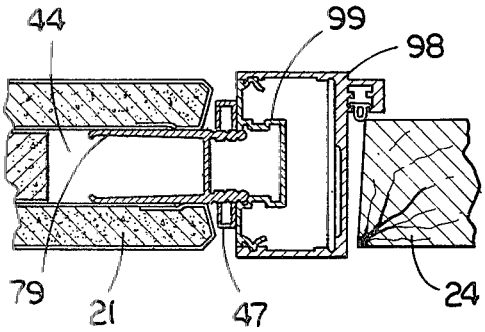
FIG. 13 is a partial top plan section view of a panel-to-door joint comprising a portion of the FIG. 1 system.
Figure 14:
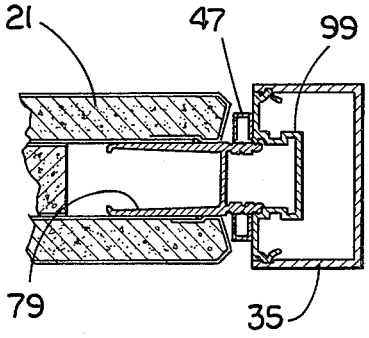
FIG. 14 is a partial top plan section view of a panel-to-edge casing joint comprising a portion of the FIG. 1 system.

Referring to FIGS. 13 and 14, additional structural components are illustrated which are typically associated with doors and free-edge configurations. In FIG. 13, a door jamb assembly is illustrated which includes a door member connector 98 and a snap-in receiver 99. Receiver 99 is configured to snap-fit with the cylindrical ribs of panel connector 79 and is further configured to snap fit with door member connector 98. Door member 24 is approximately $1\frac{3}{4}$ inches thick and closes into abutting engagement against the outwardly extending portion of connector 98. The FIG. 13 illustration is typical on both sides of the door member and one side is configured with the hinge arrangement for the door member. FIG. 14 illustrates a construction concept with is utilized as a cased opening as well as closing off the structural wall panel when it extends outwardly to a free edge. Snap-in receiver 99 is still utilized but instead of door member connector 98, end cap 35 is employed. Although still remaining as an option, both the FIG. 13 and FIG. 14 illustrations include slotted standards and such inclusion is intended to convey the understanding that regardless of the construction configuration employed, the multifunction and interchangeability of the component parts enables such standards to be attached at all locations where panel connectors 79 are utilized.

Figure 15:
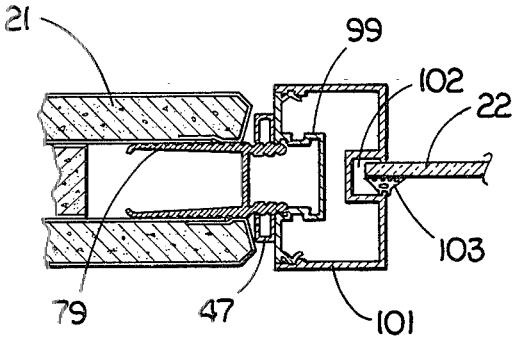
FIG. 15 is a partial top plan section view of a wall-panel-to-glass-panel joint comprising a portion of the FIG. 1 system.
Figure 16:
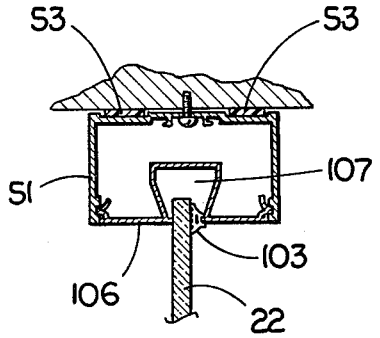
FIG. 16 is a partial side elevation section view of a glass panel secured to a ceiling comprising a portion of the FIG. 1 system.
Figure 17:
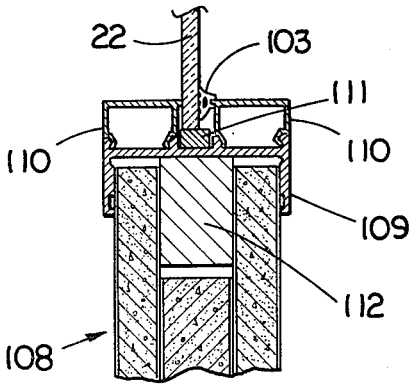
FIG. 17 is a partial side elevation section view of a glass panel secured to a sill comprising a portion of the FIG. 1 system.

Referring to FIGS. 15, 16 and 17, the means of attaching glass panels is illustrated. In FIG. 15, the side edge of a glass panel 22 is attached to a structural wall panel 21. The joint between these two panels requires a wall panel connector 79, a glass panel connector 101 and a snap-in receiver 99 therebetween. It should be noted at this point that connector 101, end cap 35 and door member connector 98 are all configured identically with respect to their snap-fit engagement with receiver 99. Furthermore, the wall thickness and general dimensioning of these parts are all identical with the exception of one side wall. When this part is intended as an end cap, the side wall is substantially flat. When configured for a door member, the side wall is structurally contoured for receipt of the door and support of door hinges. When configured for receipt of glass panel 22, a glass-receiving groove 102 and glass-grip seal 103 are provided.

Figure 18:
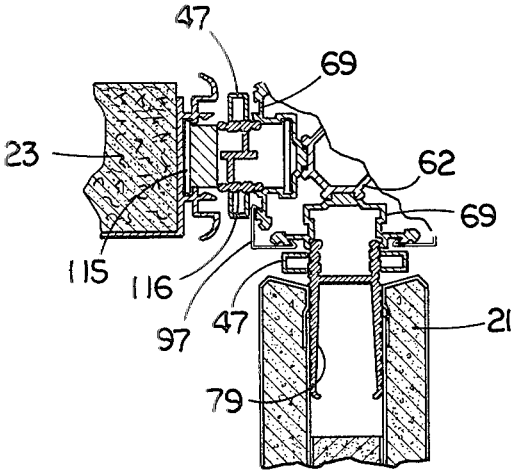
FIG. 18 is a partial top plan section view of a wall panel to acoustical screen joint comprising a portion of the FIG. 1 system.

FIGS. 16 and 17 illustrate the overhead retention of glass panel 22 and the sill construction for the glass panel. While reference is made to the term "glass," it is to be understood that the construction concepts disclosed are equally applicable to any type of window panel concept. For example, translucent plastics or ventian blinds could be replacements for the "glass." In furtherance of the multifunction and interchangeable nature of the component parts described herein, it is to be noted that ceiling runner 51 which has been previously been described for receipt of a structural wall panel is equally adaptable for receipt of glass panel 22 by means of extruded adaptor connector 106. Connector 106 is arranged with a clearance region 107 and a glass-grip seal 103 and snap-fits into ceiling runner 51. The lower portion of glass panel 22 is set in place on a sill. A reduced-size structural wall panel 108 forms the sill, and the joint is completed by exterior panel adaptor 109, partial glass support brackets 110, shim strip 111 and support block 112. The installation procedure of the glass panels between the ceiling and sill level begins with the insertion of the glass panel into clearance region 107 and movement of the glass panel to its upwardmost location. This then provides clearance at the sill level and support block 112 is adhesively secured in place within groove 44 and is positioned at a point to assure dimensional compatibility with the particularly sized glass panel. Next, adaptor 109 is fitted onto the wall panel and onto block 112. Next, one support bracket is snapped into position, the shim strip is inserted, and the glass panel is lowered onto the shim strip. It is noted that the overall height of the glass panel is sufficient to adapt to the sill joint as illustrated, and still be retained by glass-grip seal 103 at the ceiling level. The final installation is to snap the remaining support bracket into place by which action, the glass panel is sandwiched between these two brackets and grip seal 103. While partitioning system 20 has been illustrated as incorporating means to selectively and uniquely assembly structural wall panels, door members and glass panels, the system disclosed herein is also applicable for the incorporation of acoustical screens while retaining its desirable multifunction and interchangeable aspects. FIG. 18 illustrates a 90° joint between a structural wall panel 21 and an acoustical screen 23. Since this joint concept incorporates corner spacer 62 and face plate members 69, it should be apparent that a great variety of configurations are possible involving pluralities of screens, wall panels, door members and glass panels. By retention of the corner spacer and the face plate members, the uniqueness of the joining technique is retained. In order for acoustical screen 23 to adapt to the standarized components of the joint, the screen edge is configured with a connector design which is compatible for snap-fit within the face plate member 69. The acoustical screen connection includes screen frame 115 and a snap-in connector 116. Connector 116 is similar in certain regards to panel connector 79, especially in its end configuration which snaps into face plate member 69. The differences quite logically are at the opposite end in that connector 116 does not insert into a groove but rather joins with screen frame 115. The same basic principles of this joint construction enable a plurality of screens to be assembled to themselves as well as to structural wall panels and glass panels, and the presence of slotted standards 47 further enables the use of hang-on furniture concepts as part of an acoustical screen system which heretofore had not been envisioned. In order to add additional strength and rigidity to the acoustical screens, stiffening plates are secured to the top and bottom edges of the screens. These plates are also compatible with the joint construction arrangement for additional panel-to-panel rigidity.

Although each of the various joint assembly figures, for example, FIG. 12, are arranged with a plurality of slotted standards 47, it is to be understood that by removal of these standards and deeper insertion of the connectors into the panels, the joints can be closed together.

Groove 44 is peripheral and thus system 20 is equally applicable to vertical configurations as well as horizontal and overhanging configurations. Although the corner spacers are illustrated as arranged in a vertical orientation, these spacers may be suspended in a horizontal manner equally as well and thereby create greater system versatility. The acoustical screens and glass panels have compatible edge configurations which permit their adaptability to horizontal arrangements.

Figure 19:
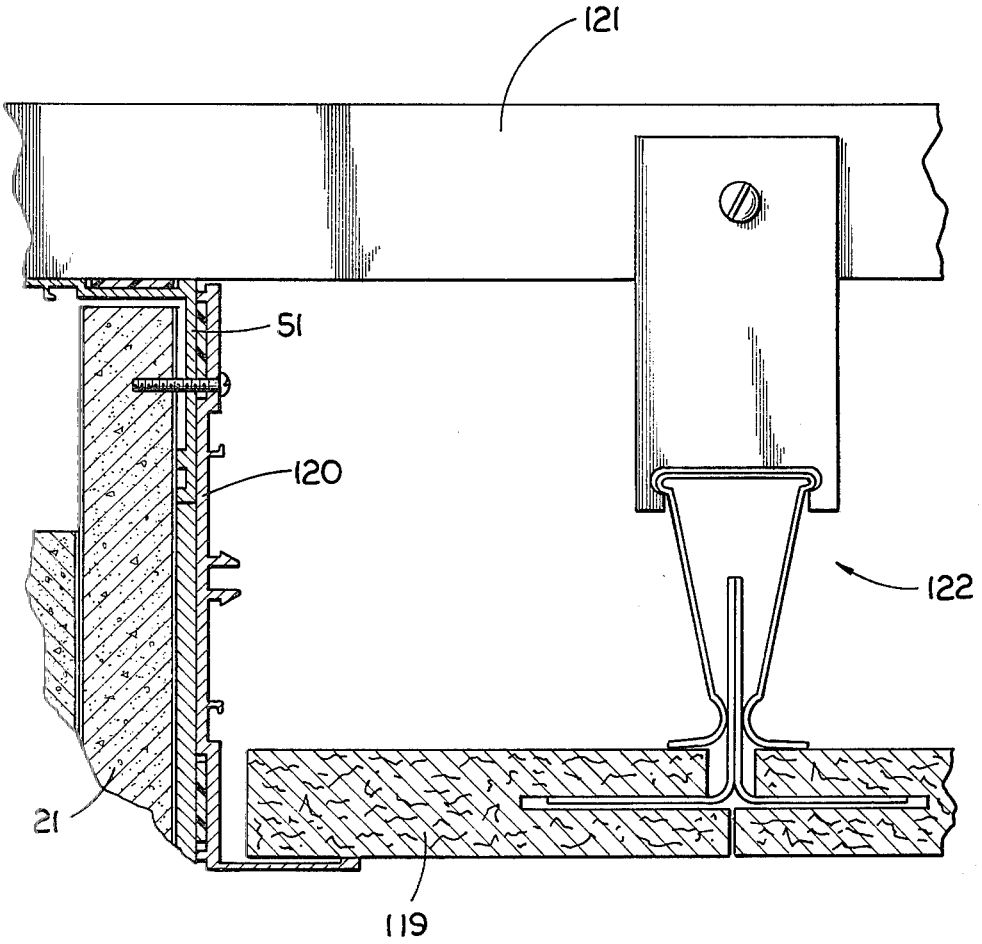
FIG. 19 is a partial side elevation section view of a wall panel and suspended ceiling connection comprising a portion of the FIG. 1 system.

Referring to FIG. 19, a further feature of the disclosed partitioning system is illustrated. Inasmuch as partitioning systems of the type disclosed herein may be incorporated as part of an area which has a significantly higher permanent ceiling, such as a warehouse, means are provided for suspending a false ceiling as part of the partitioning system. Ceiling 119 is inset below the upper edge of wall panel 21 and is edge trimmed around its periphery by shelf brackets 120. Brackets 120 are each attached to ceiling runners 51 which are in direct contact with the upper edge of the enclosing wall panels. This direct contact helps to distribute the ceiling weight load over a larger bearing area. Secured to the top surface of the ceiling runners 51 are steel tube joists 121 which span the area enclosed by the ceiling in an equally spaced apart manner.

Downwardly suspended from the various joists is a plurality of ceiling suspension arms 122 which are conventional in most respects and fit to and between the various panels which comprise ceiling 119. This construction concept is compatible with individual ceiling panels and is particularly well suited for rearrangements. The partition wall panels provide the support for the ceiling and the entire office can be relocated without having to affect any structural attachments to the building.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A partition assembly for segmenting an open area having a floor and a ceiling into smaller compartment-like regions, said partition assembly comprising:

a plurality of space-dividing, generally rectangular panel members extending from said floor to said ceiling and joined together along adjacent longitudinal edges;

a panel joint assembly positioned between said adjacent edges for joining said panels along said adjacent longitudinal edges, said joint assembly including a panel connector attached to each of said adjacent edges of said panel members;

a face plate adapted for lateral snap-fit receipt of said panel connector, said face plate member having a central attachment portion; and a corner spacer adapted for attachment with a plurality of said face plate members, said corner spacer including a plurality of attachment means equally radially spaced about a center portion thereof for receiving said central attachment portion of said face plate members, said attachment means governing panel-to-panel angular relationships, said attachment means adapted to mate with said central attachment portion in a nesting relationship so as to permit free lateral nesting and removal of said central attachment portion from a corresponding attachment means; and means separate from said attachment portion and said attachment means for releasably securing said attachment portion and said attachment means.

2. The partition assembly of claim 1 wherein said panel members are constructed of two gypsum sheets spaced apart by coreboards in a laminated arrangement, each of said panel members having a peripheral edge groove for receipt of said panel connectors, said panel connectors being slidable within said groove for adjusting the spacing between said adjacent edges.

3. The partition assembly of claim 1 wherein each face plate member has a lateral cross-section of a generally U-shaped main body portion and two outwardly-extending oppositely directed arms, the interior surface of said main body portion configured for snap-fit receipt of said panel connectors.

4. The partition assembly of claim 3 wherein said attachment means is a slot and said attachment portion of said face plate member is a central tab which extends towards said slot and from the base of said U-shaped main body portion.

5. The partition assembly of claim 2 which further includes a plurality of slotted standards configured for support of hang-on furniture, said slotted standards being attached to said panel connectors and disposed in the space between said adjacent panel edges.

6. The partition assembly of claim 1 which further includes a ceiling runner and a floor track, said ceiling runner arranged for attachment to the open area ceiling and including a downwardly-opening panel member receiving groove, said floor track arranged for anchoring to the open area floor and configured for receiving said panel members.

7. The partition assembly of claim 1 wherein said panel members are constructed of two gypsum sheets spaced apart by coreboards in a laminated arrangement and further including a plurality of slotted standards configured for support of hang-on furniture, said slotted standards being attached to said panel connectors at the space between adjacent panel edges.

8. The partition assembly of claim 7 which further includes a plurality of ceiling support joists anchored to the uppermost edge of said panels and extending across said regions, each of said support joists being secured to a plurality of ceiling suspension arms for support of a suspended ceiling for said compartment-like regions.

9. The partition assembly of claim 1 which further includes a plurality of ceiling support joists anchored to the uppermost edge of said panels and extending across said regions, each of said support joists being secured to a plurality of ceiling suspension arms for support of a suspended ceiling for said compartment-like regions.

10. A partition assembly for segmenting an open area having a floor and a ceiling into smaller compartment-like regions, said partition assembly comprising:

a plurality of space-dividing, generally rectangular panels including at least one structural wall panel extending between said floor and said ceiling and at least one acoustical screen panel, said panels being joined along adjacent longitudinal edges;

a panel joint assembly positioned between said adjacent edges for joining said panels along said adjacent longitudinal edges, said joint assembly including a panel connector attached to said adjacent edges of said panels;

a face plate member adapted for lateral snap-fit receipt of said panel connector; and a corner spacer adapted for attachment with a plurality of said face plate members, said corner spacer including a plurality of face plate attachment means equally radially spaced about a center portion thereof, said attachment means governing panel-to-panel angular relationships, said attachment means adapted for receipt of said face plate members so as to permit free lateral nesting and removal of a portion of each of said face plate members with a corresponding one of said attachment means; and means separate from said face plate member and said attachment means for releasably securing said face plate members to said attachment means.

11. The partition assembly of claim 10 wherein said panel members are constructed of two gypsum sheets spaced apart by coreboards in a laminated arrangement, each of said panel members having a peripheral edge groove for receipt of said panel connectors, said panel connectors being slidable within said groove for adjusting the spacing between said adjacent edges.

12. The partition assembly of claim 10 wherein each face plate member has a lateral cross-section of a generally U-shaped main body portion and two outwardly-extending oppositely directed arms, the interior surface of said main body portion being configured for snap-fit receipt of said panel connector.

13. The partition assembly of claim 12 wherein said attachment means is a slot and each of said face plate members further includes an outwardly-protruding tab at the base of said U-shaped main body portion, said tab being received in one of said plurality of slots of said corner spacer for joining said panels.

14. The partition assembly of claim 10 which further includes a plurality of slotted standards configured for support of hang-on furniture, said slotted standards being attached to said panel connectors and disposed in the space between said adjacent panel edges.

15. The partition assembly of claim 14 wherein said attachment means is a slot and said face plate member further includes an outwardly-protruding tab adapted for receipt by one of said plurality of slots of said corner spacer, said outwardly-protruding tab being secured in said slot by said securing means.

16. A partition assembly for segmenting an open area having a floor and a ceiling into smaller compartment-like regions, said partition assembly comprising:

a plurality of generally rectangular, space-dividing panel members extending from said floor to said ceiling joined together along adjacent longitudinal edges, each panel member having a peripheral edge groove extending along said longitudinal edges;

a panel joint assembly positioned between said adjacent edges for joining said panels along said adjacent edges, said joint assembly including a panel connector having a base portion slidably insertable into said groove and an outwardly-extending connector portion extending beyond said edge of said panel member and forming oppositely-facing mounting surfaces;

a face plate member adapted for lateral snap-fit receipt of said connector portion of said panel connector;

a corner spacer adapted for attachment with a plurality of said face plate members;

means for securing said face plate member to said corner spacer; and a plurality of slotted standards configured for support of hang-on furniture, said slotted standards being attachable to a corresponding one of said oppositely facing mounting surfaces.

* * * * *